US006282392B1

(12) United States Patent
Yamaguchi

(10) Patent No.: US 6,282,392 B1
(45) Date of Patent: Aug. 28, 2001

(54) IMAGE FORMATION APPARATUS

(75) Inventor: Chiseki Yamaguchi, Niigata (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/521,097

(22) Filed: Mar. 7, 2000

(30) Foreign Application Priority Data

Mar. 11, 1999 (JP) ..... 11-065620
Mar. 11, 1999 (JP) ..... 11-065621

(51) Int. Cl.[7] ..... G03G 15/01; G03G 15/10

(52) U.S. Cl. ..... 399/237; 399/147; 399/154; 399/249; 399/307

(58) Field of Search ..... 399/237, 241, 399/246, 249, 251, 307, 154, 147, 302

(56) References Cited

U.S. PATENT DOCUMENTS

| | | | | |
|---|---|---|---|---|
| 3,776,723 | * | 12/1973 | Royka et al. | 399/237 X |
| 3,924,945 | * | 12/1975 | Weigl | 399/237 X |
| 3,978,817 | * | 9/1976 | Hauser et al. | 399/249 X |
| 4,010,288 | * | 3/1977 | Souma | 399/237 X |
| 4,049,344 | * | 9/1977 | Simpson et al. | 399/147 |
| 5,216,466 | * | 6/1993 | Mitani | 399/154 |
| 5,237,368 | * | 8/1993 | Itoh et al. | 399/147 X |
| 5,291,251 | * | 3/1994 | Storlie et al. | 399/147 |
| 5,841,456 | * | 11/1998 | Takei et al. | 399/249 X |

FOREIGN PATENT DOCUMENTS

| | | |
|---|---|---|
| 47-4435 | 2/1972 | (JP) . |
| 52-15327 | 2/1977 | (JP) . |
| 58-143362 | 8/1983 | (JP) . |
| 60-22171 | 2/1985 | (JP) . |
| 60-51864 | 3/1985 | (JP) . |
| 61-210380 | 9/1986 | (JP) . |
| 62-165682 | 7/1987 | (JP) . |
| 2-139576 | 5/1990 | (JP) . |
| 2-187782 | 7/1990 | (JP) . |
| 2-269367 | 11/1990 | (JP) . |
| 4-60676 | 2/1992 | (JP) . |
| 4-158385 | 6/1992 | (JP) . |
| 4-238372 | 8/1992 | (JP) . |
| 4-278977 | 10/1992 | (JP) . |
| 4-372972 | 12/1992 | (JP) . |
| 5-150672 | 6/1993 | (JP) . |
| 5-197298 | 8/1993 | (JP) . |
| 6-236092 | 8/1994 | (JP) . |
| 7-319292 | 12/1995 | (JP) . |
| 11-24363 | 1/1999 | (JP) . |

OTHER PUBLICATIONS

Two (2) Japanese Office Actions issued Nov. 2, 1999 in the related application, both with English translations of the relevant portions.

* cited by examiner

*Primary Examiner*—Sophia S. Chen
(74) *Attorney, Agent, or Firm*—Ostrolenk, Faber, Gerb & Soffen, LLP

(57) ABSTRACT

An image formation apparatus including an electrostatic latent image formation body, a latent image forming unit for forming an electrostatic latent image on the electrostatic latent image formation body, and a belt-shaped image carrier with an inner surface in contact with the electrostatic latent image formation body for transferring the electrostatic latent image to the belt-shaped image carrier. A developing unit supplies a liquid developer containing toner particles and carrier liquid to a surface of the belt-shaped image carrier which is not in contact with the electrostatic latent image formation body. A solvent removal unit removes the carrier liquid from the developed image so as to form a toner-developed image. A transfer-fixation block transfers and fixes the toner-developed image from the belt-shaped image carrier onto a recording medium.

19 Claims, 4 Drawing Sheets

IMAGE FORMATION APPARATUS

BACKGROUND OF THE INVENTION

1. Field of the Invention

The present invention relates to an image formation apparatus in a copying machine, facsimile, printer, or the like.

2. Description of the Related Art

In a wet toner process, a liquid developer containing charged toner particles in a carrier liquid is used for forming a developed image with toner on a developing image carrier on which a latent image has been formed, and the developed image is fixed onto a recording medium such as paper. In such a wet toner process, a photosensitive body serves as a carrier of the latent image and the developed image.

Moreover, when using a liquid developer, transfer and fixation onto a recording medium requires squeezing and drying for removing the carrier liquid in the developed image.

Moreover, in the method using a liquid developer, a developed image is formed directly on a photosensitive body, the photosensitive body should have predetermined characteristics (swelling property, heat resistance, and a long service life), which increases production costs.

During development, a developing roller is used to supply a liquid developer onto a latent image carrier (photosensitive body). The liquid developer always is in contact with the latent image carrier. The liquid developer is also applied to a non-image portion, thus the carrier liquid is wasted, a surplus liquid developer (especially, carrier liquid) is wasted before and after an image formation, squeezing and drying are required, a change of the liquid developer characteristics due to contact with the latent image carrier occurs, the image formation is not stable, and the running cost is increased.

Furthermore, since a belt-shaped photosensitive body is often used, troublesome replacement of the belt-shaped photosensitive body is required, which also costs much, thus increasing the running cost.

Moreover, in order to obtain a high-speed and high-quality color image by the electro-photograhic method, it is possible to employ a tandem type image formation apparatus using a liquid developer which can use a small-diameter toner and a plurality of exposure systems and developing units. However, when using a single photosensitive body, charging, exposure, and developing units arranged around the photosensitive body, having different mounting angles with respect to the drum shape, and the developing unit using a liquid developer requires a solvent removal step. This complicates the design configuration, and the size of the photosensitive drum diameter is increased.

Moreover, in a case of superimposing color images on the photosensitive body using a liquid developer, a carrier liquid of the liquid developer is in direct contact with the photosensitive body. Accordingly, the photosensitive body should have countermeasures against swelling and squeezing and drying durability, which costs much. Moreover, when color superimposing is performed on the photosensitive body, a toner layer developed first reduces the exposure amount for the next color development exposure, impinging accurate color reproduction.

When a plurality of photosensitive drums are used, if development is performed on the photosensitive body surface, the photosensitive drums should have countermeasures against swelling and squeezing and drying durability.

Furthermore, when development is of a contact type using a developing roller, the liquid developer is applied also to a non-image portion, and a carrier liquid is applied to the image portion. Later, the carrier liquid should be removed. This increases the load on the image carrier. When using an intermediate transfer body, if development is performed on the photosensitive body, the photosensitive body should have special characteristics and the apparatus size should be fairly large.

On the other hand, there has been suggested a process to transfer a latent image from a photosensitive body to a film and then develop the latent image. That is, a film is brought into contact to the photosensitive body on which a latent image has been formed, and then the image is developed with powder. This latent image transfer does not occur sufficiently, and the powder development cannot realize a high resolution.

Furthermore, there is a method for exposing the photosensitive body having a fixed film. In this case, the film should be transparent. However, the film is often stained by the developer, decreasing the reliability.

Moreover, in a conventional color image formation apparatus using an intermediate transfer film, a photosensitive body on which an electrostatic latent image is formed, is covered with film and powder developer. Sufficient electrostatic transfer cannot be obtained only by covering with the photosensitive body film and powder, thus development cannot realize a high-resolution image. Furthermore, there is a method to expose the photosensitive body covered with an intermediate transfer film. In this case, the film should be transparent. The developer may stain an unnecessary portion, decreasing the reliability.

Japanese Patent Publication No. 6-236092 discloses a method in which an electrostatic latent image formed on a photosensitive body is electrostatically transferred onto an intermediate transfer film and a liquid developer is used, but a single exposure system is used. Moreover, since developer is performed by a roller development, i.e., a contact type, a non-image portion is stained, carrier liquid is consumed, and excessive amount of liquid developer (especially carrier) is consumed before and after the image formation. All of the above increase load on the squeezing and drying process, lowering durability. Furthermore, respective color developing units are arranged at a portion where the belt-shaped photosensitive body and the intermediate transfer film are superimposed, which makes the photosensitive body large.

SUMMARY OF THE INVENTION

It is therefore an object of the present invention to provide an image formation apparatus capable of obtaining a high resolution in a stable state as well as excellent durability and providing reduced production cost.

Another object of the present invention is to provide an image formation apparatus capable of having a high reliability and durability and capable of providing a high-resolution image at a high speed and at a reasonable cost.

The image formation apparatus according to the present invention comprises: an electrostatic latent image formation body; latent image forming unit for forming an electrostatic latent image on the electrostatic latent image formation body; a belt-shaped image carrier having a dielectric characteristic whose inner surface is brought into contact with the electrostatic latent image formation body, so that an electrostatic latent image is transferred; developing unit for supplying a liquid developer containing toner particles and carrier liquid, to an opposite surface of the belt-shaped image carrier not in contact with the electrostatic latent image formation body; solvent removal unit for removing the carrier liquid from the developed image so as to form a toner-developed image; and a transfer-fixation block for transferring and fixing the toner-developed image from the belt-shaped image carrier onto a recording medium.

With this configuration, when the electrostatic latent image formation body having an electrostatic latent image formed by the latent image formation unit is brought into contact with the belt-shaped image carrier, the electrostatic latent image is electrostatically transferred onto the belt-shaped image carrier and the electrostatic latent image formed on the opposite surface not in contact is developed into a developed image by a liquid developer. Furthermore, carrier liquid is removed by the solvent removal unit from the developed image so as to form a toner-developed image. The toner-developed image is transferred and fixed onto a recording medium in the transfer-fixation block. Thus, an image information of the latent image forming unit is formed onto the recording medium.

In this invention, a liquid developer is used and accordingly, it is possible to obtain a high-quality image formation. Moreover, development and fixation are performed without any effect on the electrostatic latent image formation body. Accordingly, there is no need for accommodation thermal characteristics or swelling of the electrostatic latent image formation body, allowing use of a conventional low-price material having excellent durability.

The developing unit may be a flight type developing unit which is not in contact with the belt-shaped image carrier. The liquid developer transfers an electrostatic latent image due to an electric field.

With this configuration, the liquid developer transfer due to the electric field toward the electrostatic latent image and a non-image portion will not be stained by the liquid developer. Moreover, because a non-contact type developer is used, there is no excessive consumption of the liquid developer (especially, carrier liquid), which in return reduces the load on the squeezing and drying process, increasing durability. The liquid developer will not change characteristics because there is no contact with the electrostatic latent image carrier body (photosensitive body). Thus, it is possible to obtain stable image formation and reduce the running cost.

The image formation apparatus may further comprise an electrostatic transfer unit for electrostatically transferring an electrostatic latent image from the electrostatic latent image formation body onto the belt-shaped image carrier.

With this configuration, the electrostatic latent image formed on the electrostatic latent image formation body can be sufficiently electrostatically transferred by the electrostatic transfer unit onto the opposite surface of the belt-shaped image carrier not in contact with the electrostatic latent image formation body, enabling a user to obtain a high-quality image.

The solvent removal unit may include a heat generator and a squeeze drying roller arranged in such a manner that the belt-shaped image carrier is sandwiched by the heat generator and the squeeze drying roller.

With this configuration, the carrier liquid in the developed image can be removed almost completely by squeezing for which the squeeze drying roller and the heat from the heat generator are used.

The squeeze drying roller may be arranged inside the developing unit.

With this configuration, the carrier liquid squeezed by the squeeze drying roller can easily be returned to the developing unit for reuse.

The electrostatic latent image formation body may have a shape of a rotary drum which is in contact with an inner surface of the belt-shaped image carrier.

According to the invention having the aforementioned configuration, an electrostatic latent image is transferred to the belt-shaped image carrier from the electrostatic latent image formation body, which is in contact with the inner surface of the belt-shaped image carrier, so that an electrostatic image is formed on the outer surface of the belt-shaped image carrier. Thus, the components for forming the latent image are arranged inside of the belt-shaped image carrier while the developing apparatus as the developing means is arranged outside of the belt-shaped image carrier. This enables a user to obtain an image formation apparatus of a reduced size.

The transfer-fixation block may include a heatable guide block for guiding the travel of the belt-shaped image carrier and a fixation roller which is in a pressed contact relationship with the guide block.

With this configuration, it is possible to transfer and fix an image onto a recording medium with a simple mechanism.

The heat generator of the solvent removal unit may be built in the guide block.

With this configuration, it is possible to reduce the apparatus size in comparison to providing a separate heat generator for the solvent removal unit.

According to another aspect of the present invention, there is provided an image formation apparatus comprising: a belt-shaped image carrier having a dielectric characteristic and traveling along a predetermined path; a plurality of electrostatic latent image formation bodies arranged along the traveling path of the belt-shaped image carrier, each in contact with the belt-shaped image carrier for electrostatically transferring an electrostatic latent image onto the belt-shaped image carrier; latent image formation unit for forming an electrostatic latent image on the electrostatic image formation bodies; developing unit for supplying a liquid developer containing toner particles and carrier liquid, to a surface of the belt-shaped image carrier not in contact with the electrostatic latent image, so as to form a developed image; color image formation units including solvent removal unit for removing the carrier liquid from the developed image so as to form a toner-developed image; and a transfer-fixation block arranged on the traveling path of the belt-shaped image carrier for transferring and fixing the toner-developed image from the belt-shaped image carrier onto a recording medium.

With this configuration, in the color image formation units for forming images of different colors, the electrostatic latent image formation body (photosensitive body) on which an electrostatic latent image has been formed by the latent image formation unit is brought into contact with the belt-shaped image carrier and the electrostatic latent image is electrostatically transferred. An electrostatic latent image is formed on the opposite surface of the belt-shaped image carrier which is not in contact with the photosensitive body. The electrostatic image is developed by a liquid developer and the carrier liquid adhered to the developed image is removed by the solvent removal unit. Thus, the developed images of the respective colors are successively superimposed on the belt-shaped image carrier and a full color toner-developed image is obtained on the belt-shaped image carrier. This toner-developed image is transferred and fixed onto a recording medium in the transfer-fixation block. Thus, the color image information of the latent image formation unit is formed onto the recording medium.

Because the present invention uses a liquid developer, it is possible to obtain a high-resolution image. Moreover, since the image formation apparatus is a tandem type using a plurality of exposure systems and developing units, it is possible to obtain a high-speed image formation. Moreover, development and fixation are performed without any effects on the electrostatic latent image formation body (photosensitive body) and accordingly, the electrostatic latent image formation body need not accommodation thermal characteristics or swelling and can provide high reliability and durability. Moreover, since it is possible to use a conventional low-price material, the image formation apparatus can be realized at a low cost.

The developing unit may be an electrostatic type developing unit in which liquid developer electrostatically transfers to the electrostatic latent image due to of an electric field without any contact with the belt-shaped image carrier.

With this configuration, the liquid developer electrostatically transfers to the electrostatic latent image due to the electric field and accordingly, the liquid developer will not stain a non-image portion. Moreover, because of this non-contact type developer, there is no unnecessary consumption of the liquid developer (especially, carrier liquid) before and after the image formation. That is, there is no unnecessary load of squeezing and drying which lowers durability. The liquid developer will not change characteristic because there is no contact with the belt-shaped image carrier on which the electrostatic latent image was formed. Thus it is possible to obtain a stable image and reduce the running cost.

Each of the color image formation units may include an electrostatic transfer unit for electrostatically transferring the electrostatic latent image from the electrostatic latent image forming body onto the belt-shaped image carrier.

With this configuration, the electrostatic latent image formed on the electrostatic latent image formation body by the electrostatic transfer unit can be sufficiently electrostatically transferred to form an electrostatic latent image on the opposite surface of the belt-shaped image carrier which is not in contact with the electrostatic latent image formation body. Thus, it is possible to obtain a high-quality color image.

The solvent removal unit may include a heat generator and a squeeze drying roller, so as to press the belt-shaped image carrier between the heat generator and the squeeze drying roller.

With this configuration, it is possible to remove the carrier liquid from the developed image almost completely by the squeezing of the squeeze drying roller and the heat of the heat generator.

The squeeze drying roller may be arranged inside of the developing unit.

With this configuration, the carrier liquid squeezed by the squeeze drying roller can easily be returned to the developing unit for reuse.

The electrostatic latent image formation bodies of the color image formation units may be drum-shaped rotary electrostatic latent image formation bodies each having an identical diameter and being in contact with the inner surface of the belt-shaped image carrier.

With this configuration, an electrostatic latent image is transferred to the belt-shaped image carrier from the drum-shaped electrostatic latent image formation body which is in contact with the inner surface of the belt-shaped image carrier and an electrostatic latent image is formed on the outer surface of the belt-shaped image carrier. Thus, components for forming the latent image is arranged inside the belt-shaped image carrier while the developing unit serving as the developing unit is arranged outside the belt-shaped image carrier. This reduces the size of the image formation apparatus. Moreover, the drum-shaped electrostatic latent image formation bodies each have an identical diameter for the respective color image formation units. This facilitates the apparatus maintenance including replacement.

The distances between the contact points between the drum-shaped electrostatic latent image formation bodies and the belt-shaped image carrier are equal to the circumferential length of the drum-shaped electrostatic latent image formation bodies multiplied by an integer.

With this configuration, the drum-shaped electrostatic latent image formation bodies can be synchronized with the belt-shaped image carrier so that the respective color images can be accurately superimposed on the belt-shaped image carrier.

The length of the belt-shaped image carrier is equal to the circumferential length of the drum-shaped electrostatic latent image formation body multiplied by an integer.

With this configuration, the drum-shaped electrostatic latent image formation bodies can be synchronized with the belt-shaped image carrier so that the respective color images can be accurately superimposed on the belt-shaped image carrier.

DESCRIPTION OF THE PREFERRED EMBODIMENTS

Hereinafter, explanation will be given on an image formation apparatus according to preferred embodiments of the present invention with reference to the attached drawings.

Figure 1:
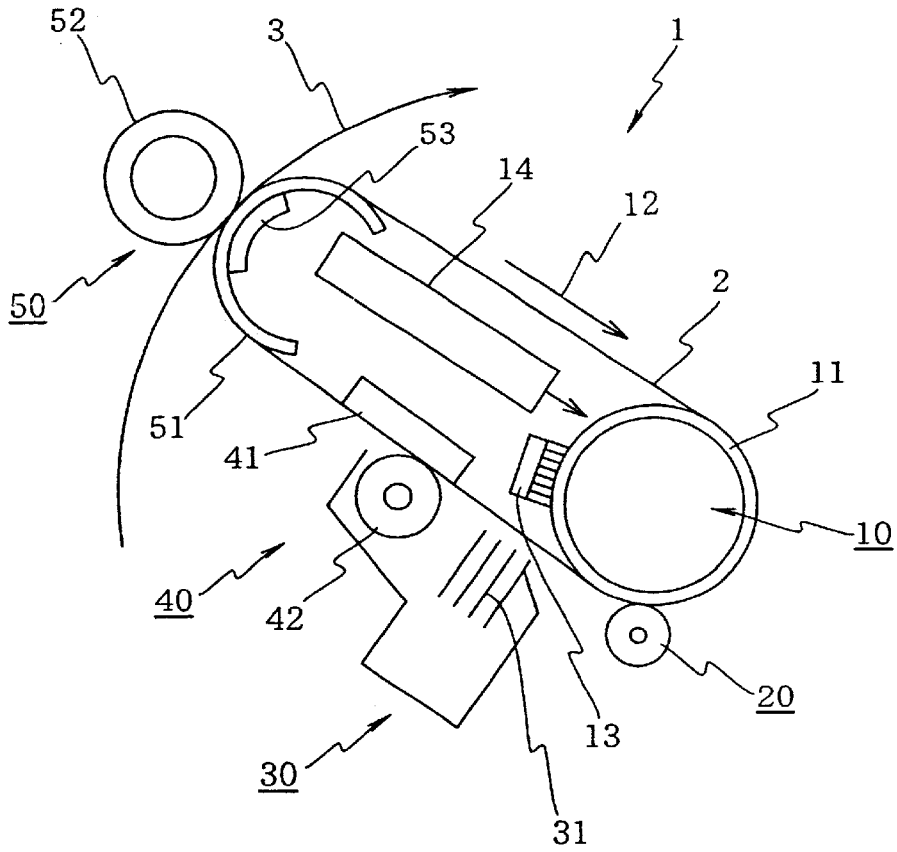
FIG. 1 schematically shows a configuration of an image formation apparatus according to a first embodiment of the present invention.

FIG. 1 schematically shows an image formation apparatus according to a first embodiment of the present invention. In this image formation apparatus 1, an endless belt-shaped image carrier 2 runs through an electrostatic latent image formation block 10, electrostatic latent image transfer unit 20, developing unit 30, solvent removal unit 40 and transfer-fixation block 50.

The belt-shaped image carrier 2 is rotatably supported so as to constitute the electrostatic latent image formation block 10, which is arranged on a photosensitive drum 11 as an electrostatic latent image formation body and a guide block 51 constituting a transfer-fixation block 50, so as to be driven to run in a direction 12.

Accordingly, the photosensitive drum 11 functions as a belt wheel to drive the belt-shaped image carrier 2, and is in abutment with an inner surface of the belt-shaped image carrier 2. The circumferential speed of the photosensitive drum 11 is identical to the running speed of the belt-shaped image carrier 2.

The belt-shaped image carrier 2 is made from heat-resistant polyimide, polyetherimide, polyester or the like and has a thickness of 100 micrometers or less. The belt-shaped image carrier has an outer surface which has been subjected to a surface processing using silicone, fluorine and so on, so that a developed image is easily transferable out.

The latent image formation block 10 is constituted by the photosensitive drum 11, a charging brush 13 and a laser scan optical system 14. The photosensitive drum 11 has on its outer surface an organic or inorganic photosensitive agent layer. Inside the belt-shaped image carrier 2, there are arranged the photosensitive drum 11 and the charging brush 13 for charging the photosensitive drum 11. Moreover, the laser scan optical system 14 is arranged as the latent image formation unit for forming an electrostatic latent image according to an image information on the surface of the charged photosensitive drum 11.

An electrostatic transfer roller 20 as the electrostatic latent image transfer unit is arranged to face the photosensitive drum 11 so as to sandwich the belt-shaped image carrier 2, so that an electrostatic latent image formed on the photosensitive drum 11 is electrostatically transferred onto an outer surface of the belt-shaped image carrier 2.

Moreover, an electrostatic-type developing unit 30 as the developing unit is arranged outside of the belt-shaped image carrier 2 not in contact with the belt-shaped image carrier 2, for developing the latent image which has been transferred onto the belt-shaped image carrier 2.

Moreover, as the solvent removal unit 40 for removing a carrier liquid from the developed image for forming a toner developed image of the belt-shaped image carrier 2, there are provided a line-shaped heat generator 41 arranged in contact with the inner surface of the belt-shaped image carrier 2 for heating the developed image formed on the belt-shaped image carrier 2; and a squeeze drying roller 42 which is rotatably supported by the line-shaped heat generator 41, for squeezing the carrier liquid contained in the developed image formed on the belt-shaped image carrier 2. This squeeze drying roller 42 is arranged in the electrostatic-type developing unit 30.

Furthermore, the transfer-fixation block 50 for transferring and fixing the developed image from the belt-shaped image carrier 2 onto the recording medium includes a guide block 51 having an arc-shaped cross section for guiding the running of the belt-shaped image carrier 2, and a transfer-fixation roller 52 rotating to push the recording medium 3 passing through the transfer-fixation block 50, against the belt-shaped image carrier 2.

The line-shaped heat generator 53 is arranged at a portion of the guide block 51 facing the transfer-fixation roller 52. It should be noted that although not depicted, between the guide block 51 and the photosensitive drum 11, there are provided a cleaner for cleaning the belt-shaped image carrier 2 and a charge cleaner for removing static electricity from the belt-shaped image carrier 2.

Figure 2:
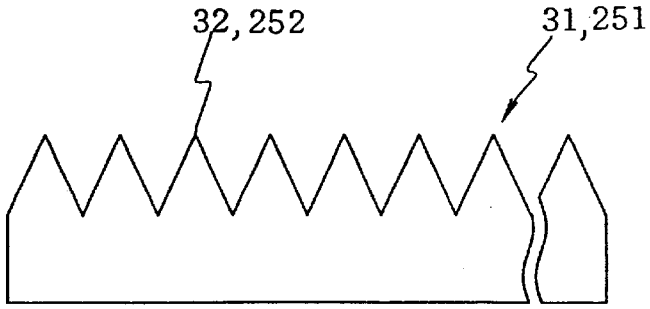
FIG. 2 schematically shows a line head of an electrostatic type development apparatus used in the image formation apparatus of the present invention.

In the electrostatic-type developing unit 30, a plurality of line heads 31 to which developing bias is applied are arranged in the traveling direction of the belt-shaped image carrier 2. As shown in FIG. 2, the line head has a saw-tooth edge 32 for applying the toner particles in the liquid developer only to an image portion formed on the belt-shaped image carrier 2. The saw-tooth edge 32 is formed in the width direction of the belt-shaped image carrier 2. The clearance between this saw-tooth edge 32 and the belt-shaped image carrier 2 is 0.5 to 1.0 mm. The liquid developer containing toner particles and carrier liquid is held between the line head 31.

In the electrostatic-type developing unit 30, the liquid developer held by the line head 31 is made into droplets by the electric field between the saw-tooth edge 32 of the line head 31 and the electrostatic latent image and the droplets electrostatically transfer to the electrostatic latent image so as to develop the electrostatic latent image. Accordingly, in the electrostatic-type developing unit 30, the liquid developer is applied only to the electrostatic latent image.

The two types of line-shaped heat generators 41 and 53 are flat heat generators such as a ceramics heater, a sheath heater, a thin film high resistor, and the like.

Description will now be directed to operation of the aforementioned image formation apparatus 1.

The photosensitive drum 11 is uniformly charged with a negative electric charge by the charging brush 13. An image is exposed according to an image information by the laser scan optical system 14 and an electrostatic latent image is formed on the photosensitive drum 11. The electrostatic latent image is electrostatically transferred from the photosensitive drum 11 onto the belt-shaped image carrier 2 by the electrostatic transfer roller 20 which has been subjected to positive electrostatic transfer bias. According to the negative charge distribution of the electrostatic latent image formed on the photosensitive drum 11, a positive charge distribution is formed on the belt-shaped image carrier 2 which has passed through the electrostatic transfer roller 20. Thus, the latent image to be developed is formed.

Since the photosensitive drum 11 rotates while in contact with the belt-shaped image carrier 2, electrostatic transfer is performed without distorting the image. Moreover, the voltage difference (about 750V) between the image portion (−100V) and a non-image portion (−850V) on the photosensitive drum 11 transforms into a voltage distribution of voltage difference (about 550V) between an image portion (+150V) and non-image portion (+700V) on the belt-shaped image carrier after electrostatic transfer.

In the electrostatic-type developing unit 30, developing bias (+800V) is applied to the saw-tooth edge 32 which faces the belt-shaped image carrier 2 with a clearance of 0.5 to 1.0 mm. The electrostatic latent image formed on the outer surface of the belt-shaped image carrier 2 is transformed into a developed image by the liquid developer applied from the line head 31. Thus, the developed image is formed. This is realized by the toner having a positive charge transferring from the liquid developer toward the image portion. This enables a user to obtain high-quality gradation, line reproduction and concentration.

The developed image on the belt-shaped image carrier 2 is then subjected to heat from the line-shaped heat generator 41 and pressure by the squeeze drying roller 42. Thus, the carrier liquid in the image portion is squeezed and evaporated, thus a developed image of toner layer film containing almost no carrier liquid is obtained.

After the carrier liquid is removed, the toner developed image on the belt-shaped image carrier 2 is then fed to transfer-fixation block 50 where the image is subjected to heat and pressure supplied by the line-shaped heat generator 53 and the transfer-fixation roller 52 arranged in the guide block 51, so that the image is transferred and fixed simultaneously to the recording medium 3 such as paper.

The belt-shaped image carrier 2 which has passed through the transfer-fixation block 50 is cleaned by a cleaner (not depicted) and remaining charge is removed by a charge cleaning unit (not depicted) so as to be ready for the next image formation. The carrier liquid recovered by the squeeze drying roller 42 is re-used in the developing unit 30.

With the image formation apparatus 1 having the aforementioned configuration, it is possible to form a high-quality image because the developing is performed with a liquid developer. Since the liquid developer is not in direct contact with the photosensitive drum 11, there is no danger of swelling due to the liquid developer. The drying in the solvent removal unit 40 using also heat and the transfer-fixation in the transfer-fixation block are performed without any effect on the photosensitive drum 11. Accordingly, the photosensitive material need not accommodate a thermal characteristic and it is possible to use a conventional low-cost photosensitive material. Moreover, the photosensitive drum 11 can have a long service life and its running cost can also be reduced.

Moreover, since the development is performed by electrostatic toner transfer, there is no danger of staining the non-image portion of the image carrier 2 with a liquid developer. Furthermore, during engine operation before and after an image formation, the liquid developer is not in contact with the belt-shaped image carrier 2, there is no danger of changes in the developer characteristics, and the liquid developer can be used effectively. Moreover, the load on the squeeze drying roller 42 can be reduced, thus prolonging the service life of the roller.

The photosensitive drum 11 can be replaced much easier compared to replacement of a belt-shaped photosensitive body. When the squeeze drying roller 42 removes carrier liquid from the developed image, squeeze drying is performed having no relation with the photosensitive body and accordingly, the drying condition can be set at an optimal condition without considering characteristics of the photosensitive body. Thus, it is possible to realize a preferable transfer-fixation.

Figure 3:
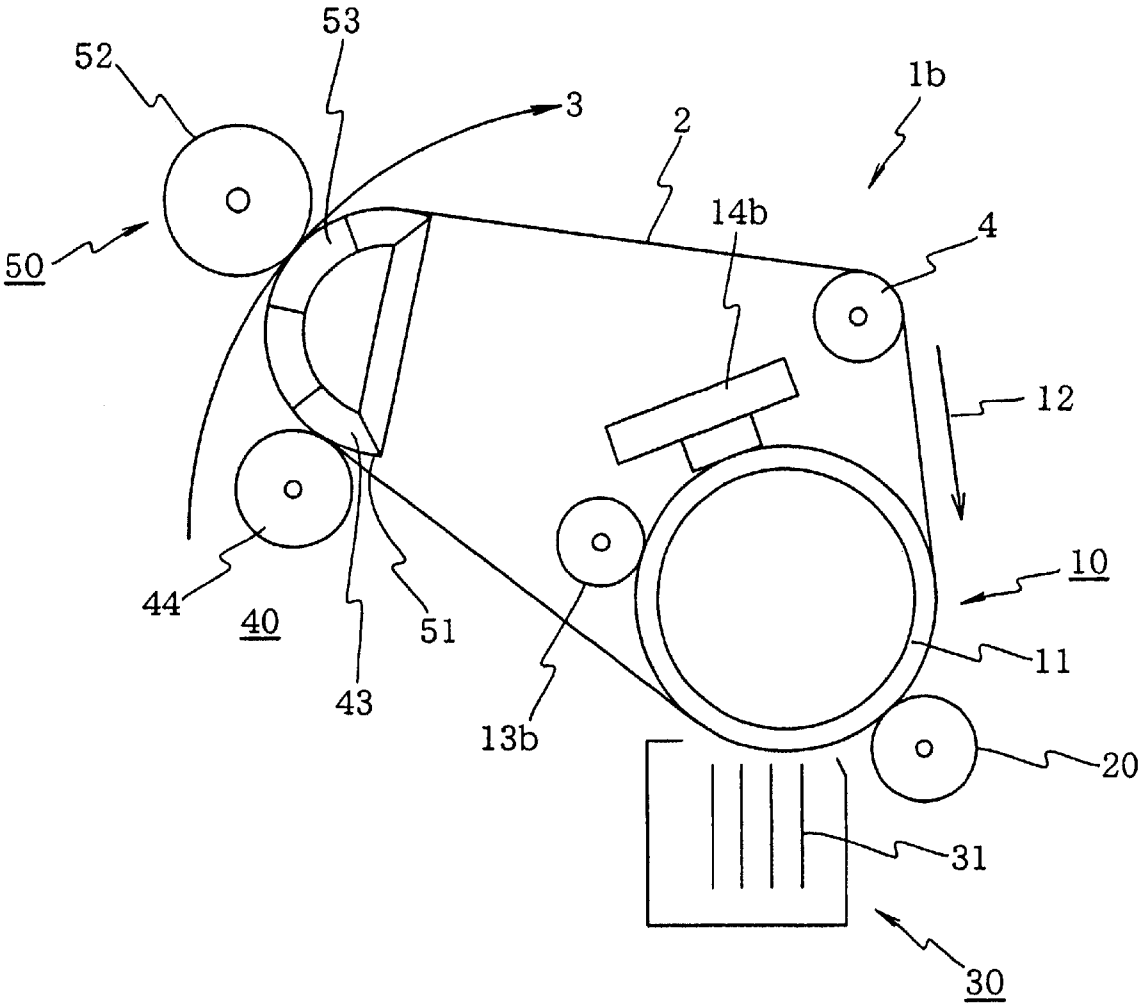
FIG. 3 schematically shows a configuration of an image formation apparatus according to a second embodiment of the present invention.

FIG. 3 schematically shows an image formation apparatus according to a second embodiment of the present invention. In this image formation apparatus 1*b*, an endless belt-shaped image carrier 2 having a dielectric characteristic travels through an electrostatic latent image formation block 10, latent image transfer unit 20, developing unit 30, solvent removal unit 40, and a transfer-fixation block 50. The belt-shaped image carrier 2 is rotatably supported and is bridged between a photosensitive drum 11 serving as an electrostatic latent image formation body, and constituting the electrostatic latent image formation block 10, a guide block 51 constituting the transfer-fixation block 50 and a support roller 4. The belt-shaped image carrier 2 is driven to travel in the direction 12. The photosensitive drum 11 functions as a belt wheel for changing the travel direction of the belt-shaped image carrier 2 and in abutment with the inner surface of the belt-shaped image carrier 2 and has a circumferential speed identical to the travel speed of the belt-shaped image carrier 2.

The electrostatic latent image formation block 10 is constituted by a photosensitive drum 11, a charge roller 13*b*, and an LED array head 14*b*. The photosensitive drum 11 has an organic or inorganic photosensitive agent layer on its outer circumferential surface. Inside the belt-shaped image carrier 2, the charge roller 13*b* is arranged for charging the photosensitive drum 11, and the LED array head 14*b* arranged for forming an electrostatic latent image on the surface of the photosensitive drum 11 according to image data.

As the electrostatic latent image transfer unit, an electrostatic transfer roller 20 is arranged to face the photosensitive drum 11 so that the belt-shaped image carrier 2 is sandwiched therebetween. An electrostatic latent image formed on the photosensitive drum 11 is electrostatically transferred onto the belt-shaped image carrier 2, so as to form an electrostatic latent image on the outer surface of the belt-shaped image carrier 2.

Moreover, outside the belt-shaped image carrier 2, where it is in contact with the photosensitive drum 11, electrostatic-type developing unit 30 is provided as the developing unit for supplying a liquid developer containing toner particles and carrier liquid for developing the electrostatic latent image formed onto the belt-shaped image carrier 2.

On the inner surface of the guide block 51 having an arc-shaped cross section, for changing the travel direction of the belt-shaped image carrier 2, there are provided a line-shaped heat generator 43 for squeeze drying constituting the solvent removal unit 40 and a fixation line-shaped heat generator 53 constituting the transfer-fixation block 50. A squeeze drying roller 44 is rotatably supported to face the squeeze drying line-shaped heat generator 43, for removing a carrier liquid from the developed image formed on the belt-shaped image carrier 2.

Moreover, a transfer-fixation roller 52 is provided to rotate while pushing the recording medium 3 via the belt-shaped image carrier 2 to the guide block 51 having the fixation line-shaped heat generator 53.

It should be noted that although not depicted, there are provided a cleaner for cleaning the belt-shaped image carrier 2 and an charge remover for removing a remaining charge.

Description will now be directed to operation of the image formation apparatus 1*b* according to the second embodiment having the aforementioned configuration.

The charge roller 13*b* uniformly applies a negative charge to the surface of the photosensitive drum 11, which is image-exposed by the LED array head 14*b* according to image data, so as to form an electrostatic latent image. Moreover, positive electrostatic transfer bias is applied to the electrostatic transfer roller 20 which transfers the electrostatic latent image from the photosensitive drum 11 to the belt-shaped image carrier 2. Corresponding to the negative charge distribution of the electrostatic latent image formed on the photosensitive drum 11, the positive charge distribution is formed on the outer surface of the belt-shaped image carrier 2 which has passed electrostatic transfer roller 20. Thus, an electrostatic latent image to be developed is formed.

The electrostatic latent image formed on the outer surface of the belt-shaped image carrier 2 is transformed into a developed image by the liquid developer electrostatically transfers from the electrostatic-type developing unit 30 shown in FIG. 2 and adhering only to an image portion.

The developed image on the belt-shaped image carrier 2 thus formed is then subjected to heat from the squeeze drying line-shaped heat generator 43 and pressure from the squeeze drying roller 44, so that the carrier liquid of the image portion is squeezed and evaporated to obtain a toner developed image containing almost no carrier liquid.

The toner developed image on the belt-shaped image carrier 2 from which carrier liquid has been removed is transferred and fixed simultaneously onto a recording medium 3 fed by a predetermined unit. The transfer and fixation are performed in the transfer-fixation block 50 by heat and pressure supplied by the line-shaped heat generator 53 arranged in the guide block 51 and the transfer-fixation roller 52. Thus, an image is formed on the recording medium. The belt-shaped image carrier 2 which has passed through the transfer-fixation block is cleaned by a cleaner (not depicted) and its charge is removed by an charge cleaner (not depicted) so as to be ready for the next image formation.

With this image formation apparatus 1*b* using a liquid developer, it is possible to obtain a high-quality image. Since the photosensitive body is not brought into contact with the liquid developer, there is no danger of swelling due to the liquid developer. Drying and transfer-fixation using heat is performed without any effects to the photosensitive body and accordingly, the photosensitive material need not have a particular thermal characteristic and it is possible to use a conventional low-price photosensitive material. Moreover, from the aforementioned, the photosensitive body can have a long service life and the running cost can be reduced.

Moreover, because development is performed by electrostatic transferral, there is no danger of staining a non-image portion of the image carrier with the liquid developer. Furthermore, during engine operation before and after the image formation, the liquid developer is not in contact with the developed image carrier (the belt-shaped image carrier 2). Accordingly, there is no change in developer characteristics and the developer can be used effectively. This also reduces the load on the squeeze drying roller 44 and the roller 44 can have a long service life.

Furthermore, because the squeeze drying line-shaped heat generator 43 is built in the guide block 51, and the electrostatic-type developing unit 30 is arranged at a position opposing the photosensitive drum 11, it is possible to obtain a small apparatus. Moreover, replacement of the photosensitive drum 11 can easily be performed in comparison to that of a belt-shaped photosensitive body.

When removing the carrier liquid from the developed image layer using the squeeze drying roller, squeeze drying is performed without any effect on the photosensitive body. Accordingly, the drying condition can be set at an optimal condition without any compromise of the photosensitive characteristic. Thus, preferable transfer-fixation can be obtained.

In the aforementioned image formation apparatus, the electrostatic-type developing unit 30 uses a plurality of line heads 31 having a saw-tooth edge. However, the line head may be such that a number of small diameter nozzles are arranged in a line. Moreover, the line head 30 may include a migration electrode for supplying the liquid developer, in the vicinity of the line head 30. Furthermore, the photosensitive drum 11 may be charged by using an electrical charge remover and a corona electrical charger in combination. Furthermore, the line-shaped heat generator may be a roller having a heat generator inside. Moreover, the transfer-fixation roller 52 for transfer and fixation may be a heat roller. Furthermore, the electrostatic transfer roller may be an electrostatic transfer charger. Moreover, in the above explanation, the negative photosensitive charging polarity is combined with the positive transfer bias applied to the electrostatic transfer unit. However, the present invention is not to be limited to this. Also, the charging polarity of the toner in the liquid developer is not to be limited to the aforementioned.

Description will now be directed to a third embodiment of the present invention with reference to the attached drawings.

Figure 4:
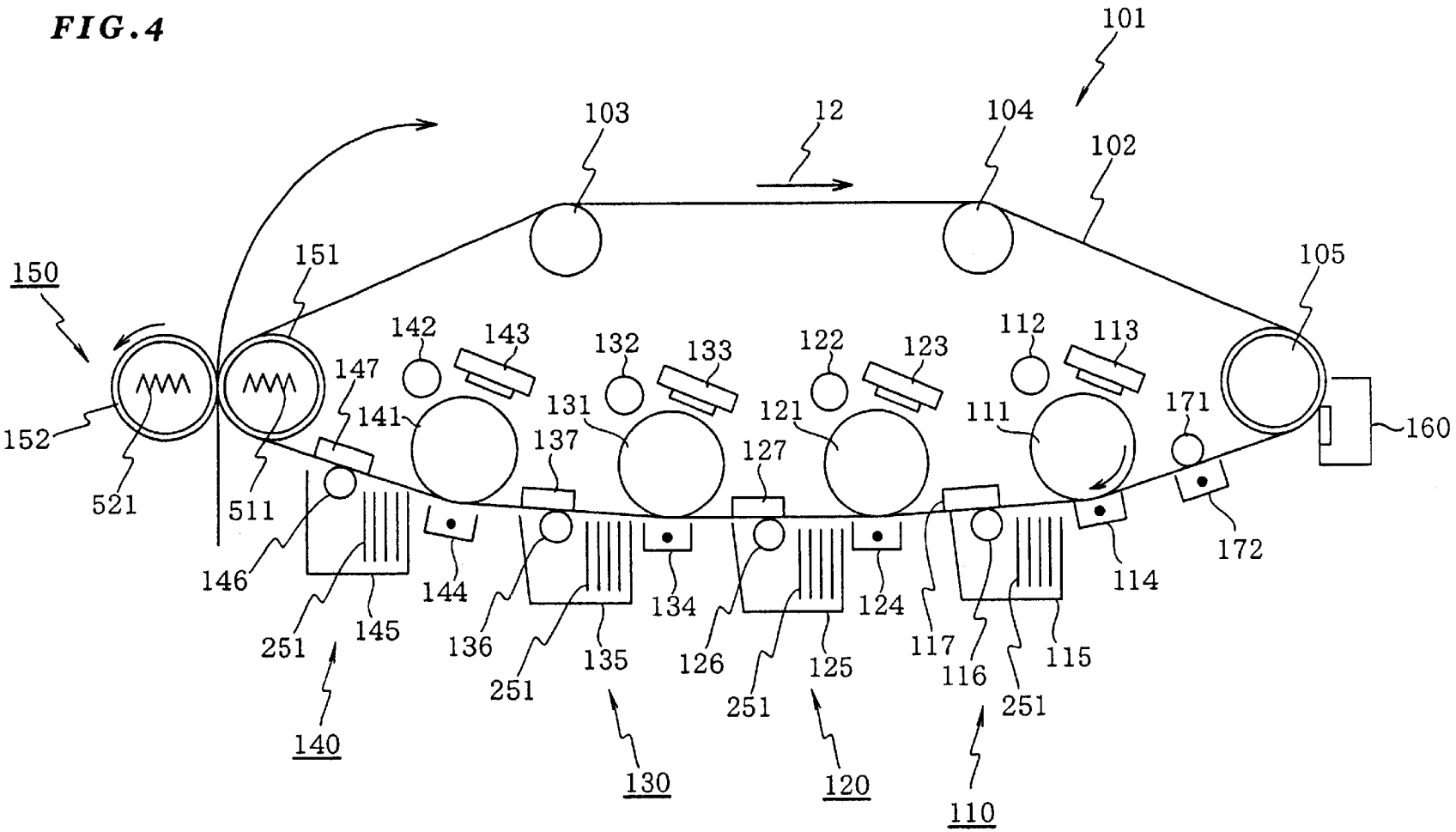
FIG. 4 schematically shows a configuration of an image formation apparatus according to a third embodiment of the present invention.

FIG. 4 schematically shows configuration of an image formation apparatus according to the third embodiment of the present invention.

This image formation apparatus 101 is of a tandem type using a plurality of exposure systems and developing units. A dielectric belt-shaped image carrier 102 is driven to travel through a predetermined traveling path in the direction 12, i.e., a support roller 103, a support roller 104, a support roller 105, a first color image formation unit 110, a second color image formation unit 120, a third color image formation unit 130, a fourth color image formation unit 140, and a transfer-fixation block 150.

The belt-shaped image carrier 102 is a film having a thickness of 100 micrometers or less and formed from heat-resistant polyimide, polyetherimide, polyester, and the like. The film surface has been subjected surface treatment using silicone, fluorine so as to facilitate separation of a developed image.

The color image formation units 110 to 140 have identical configuration with identical members. Hereinafter, the identical members will be explained as the members of the first color image formation unit 110.

The respective color image formation units 110 to 140 includes: photosensitive drums 111, 121, 131, 141 rotating along the inner surface of the belt-shaped image carrier 102 and serving as electrostatic latent image formation bodies; charge rollers 112, 122, 132, 142 for charging the photosensitive drums 111, 121, 131, 141; LED array heads 113, 123, 133, 134 as latent image formation units for exposing and forming an electrostatic latent images on the surfaces of the charged photosensitive drums 111, 121, 131, 141, according to image data; electrostatic transfer chargers 114, 124, 134, 144 for electrostatically transferring the electrostatic latent image from the photosensitive drums 111, 121, 131, 141 onto the belt-shaped image carrier 102 so as to form an electrostatic latent image on the outer surface of the belt-shaped image carrier 102; electrostatic type developing units 115, 125, 135, 145 as developing units for developing the electrostatic latent image formed on the outer surface of the belt-shaped image carrier 102, using a liquid developer; on the outer surface of the belt-shaped image carrier 102, where the photosensitive drums 111, 121, 131, 141 are not in contact with the belt-shaped image carrier 102, squeeze drying rollers 116, 126, 136, 146 constituting solvent removal units for removing carrier liquid from the developed image on the belt-shaped image carrier 102; and line-shaped heat generators 117, 127, 137, 147 constituting solvent removal units pushed by the squeeze drying rollers 116, 126, 136, 146 via the belt-shaped image carrier 102.

The photosensitive drums 111, 121, 131, 141 each have an identical diameter and have an organic or inorganic photosensitive agent on the outer circumference surface thereof. Moreover, the line-shaped heat generators 117, 127, 137, 147 each are constituted by a flat heat generator, such as a ceramics heat generator, sheath heater, thin film high resistor heater and the like.

The first color image formation unit 110, for example, forms a yellow-developed image, thus the electrostatic type developing unit 115 contains a yellow liquid developing agent. Similarly, the second color image formation unit 120 forms a magenta-developed image, thus the electrostatic type developing unit 125 contains a magenta liquid developing agent. The third color image formation unit 130 forms a cyan-developed image, thus the electrostatic type developing unit 135 contains a cyan liquid developing agent. The fourth color image formation unit 140 forms a black-developed image, thus and the electrostatic type developing unit 145 contains a black liquid developing agent.

In the respective color image formation units 110 to 140, the position of the LED array heads 113, 123, 133, 143 relative to the photosensitive drums 111, 121, 131, 141 are identical.

Moreover, in order to accurately superimpose the developed images, the contact positions between the photosensitive drums 111, 121, 131, 141 and the belt-shaped image carrier 102 are arranged at a circumference length of the photosensitive drums 111, 121, 131, 141 multiplied by an integer.

In the electrostatic type developing unit 115, a plurality of line heads 251 to which development bias is applied are arranged in the traveling direction of the belt-shaped image carrier 102. Line heads 251 have the same configuration of the line head 31 shown in FIG. 2 which is described with first embodiment.

In the electrostatic type developing unit 115, the liquid developer in the line head 251 forms droplets due to the electric field between the saw-tooth edged 252 (same as saw-tooth edge 32 in FIG. 2) of the line head 251 and an electrostatic latent image. The droplet transfers to the electrostatic latent image to develop the electrostatic latent image. Accordingly, in the electrostatic type developing unit 115, the liquid developer transfers only to the electrostatic latent image.

The squeeze drying rollers 116, 126, 136, 146 constituting the solvent removal units are arranged in the developing units 115, 125, 135, 145, and the squeezed carrier fluid is recovered for reuse.

Moreover, the color developed image superimposed by the respective color image formation units 110 to 140 on the belt-shaped image carrier 102 is transferred-fixed onto a recording medium 100 by the transfer-fixation block 150. The transfer-fixation block 150 includes: a heating roller 151 for supporting the rotation of the belt-shaped image carrier 102; and a transfer-fixation roller 152 rotating while pushing the recording medium 100 against the belt-shaped image carrier 102. The heating roller 151 has a built in heat generator 511, and the transfer-fixation roller 152 also has a built in heating generator 521.

Moreover, there are provided a cleaner 160 for cleaning the belt-shaped image carrier 102 prior to color image formation on the belt-shaped image carrier 102; and a charge removing roller 171 and a charge removing unit 172 for removing charge from both sides of the belt-shaped image carrier 102.

Next, explanation will be given on operation of the image formation apparatus of FIG. 4. Prior to image formation, the belt-shaped image carrier 102 is discharged by the cleaner 160, the charge removal roller 171, and the charge removal unit 172 while the belt-shaped image carrier 102 is traveling from the transfer-fixation block 150 to the first color image formation unit 110.

The surface of the photosensitive drum 111 is uniformly charged by the charge roller 112 of the first color image formation unit 110 and image-exposed by the LED array head 113 according to a yellow image information, so as to form an electrostatic latent image. The photosensitive drum 111 rotates at a speed identical to the travel speed of the belt-shaped image carrier 102 and is brought into tight contact with the inner surface of the belt-shaped image carrier 102. The charge distribution of the electrostatic latent image on the photosensitive drum 111 is electrostatically transferred onto the belt-shaped image carrier 102 by the electrostatic transfer charger 114 to which electrostatic transfer voltage has been applied, and for example, an electrostatic latent image having a positive charge is formed.

Next, the developing unit 115 containing a yellow liquid developer forms a yellow developed image on the belt-shaped image carrier 102. Here, the development process is realized by the electrostatic transferral of charged yellow toner toward an image portion by the electric field formed between the saw-tooth ends 252 of the line heads 251 having a development bias and the electrostatic latent image formed on the belt-shaped image carrier 102.

The carrier liquid in the yellow-developed image on the belt-shaped image carrier 102 is squeezed and evaporated by the line-shaped heat generator 117 and the squeeze drying roller 116, thus obtaining a yellow toner layer film having almost no carrier liquid. The belt-shaped image carrier 102 having the yellow image advances to the second color image formation unit 120, where a magenta toner image layer film is formed on the yellow image. Similarly, a cyan image is formed by the third color image formation unit 130, and a black image is formed by the fourth color image formation unit 140. Thus, a full color image is formed on the belt-shaped image carrier 102.

The full color image on the belt-shaped image carrier is subjected to the heat and pressure of the heating roller 151 and the transfer and fixation roller 152 and is transferred-fixed onto a recording medium 100 fed synchronously. Thus, the full color image is formed on the recording medium 100. The belt-shaped image carrier 102 from which an image has been transferred to the recording medium 100 is then used for the next color image formation.

This image formation apparatus 101 enables a user to obtain a high-quality image by way of liquid development. Since the respective color image formation units 110 to 140 have identical configurations, it is possible to reduce the cost. Moreover, because of the tandem configuration, it is possible to realize high-speed printing.

Because the liquid developer is not brought into direct contact with the photosensitive drum 111, there is no danger of swelling of the photosensitive body and it is possible to use a conventional low-price photosensitive body material.

Moreover, drying by the solvent removal unit 116, 117 using heat at the same time and transfer-fixation in the transfer-fixation block 150 are performed without having any effect on the photosensitive drum 111. Accordingly, it is possible to select a photosensitive material without accommodation a thermal characteristic of the devices, thus can use a conventional low-price photosensitive material. Thus, the photosensitive body can have a long service life and the running cost can be reduced.

Electrostatic development is a process in which a liquid developer (mainly, charged toner) adheres only to an image portion formed on the belt-shaped image carrier 102. Accordingly, there is no danger of staining a non-image portion with the carrier liquid like in a conventional contact-type development using a developing roller.

Moreover, the solvent removal unit 116 and 117 can easily remove the carrier liquid by the squeeze drying process. It is possible to significantly reduce the load on the squeeze drying process, reducing the cost. Because it is possible to obtain an optimal design of the squeeze drying process without accommodating the photosensitive body material, it is possible to form the respective color toner layers and prevent color mixing, thus enabling a user to obtain a high-quality color image.

Furthermore, replacement of the photosensitive drum 111 is easier than replacement of a belt-shaped photosensitive body.

Figure 5:
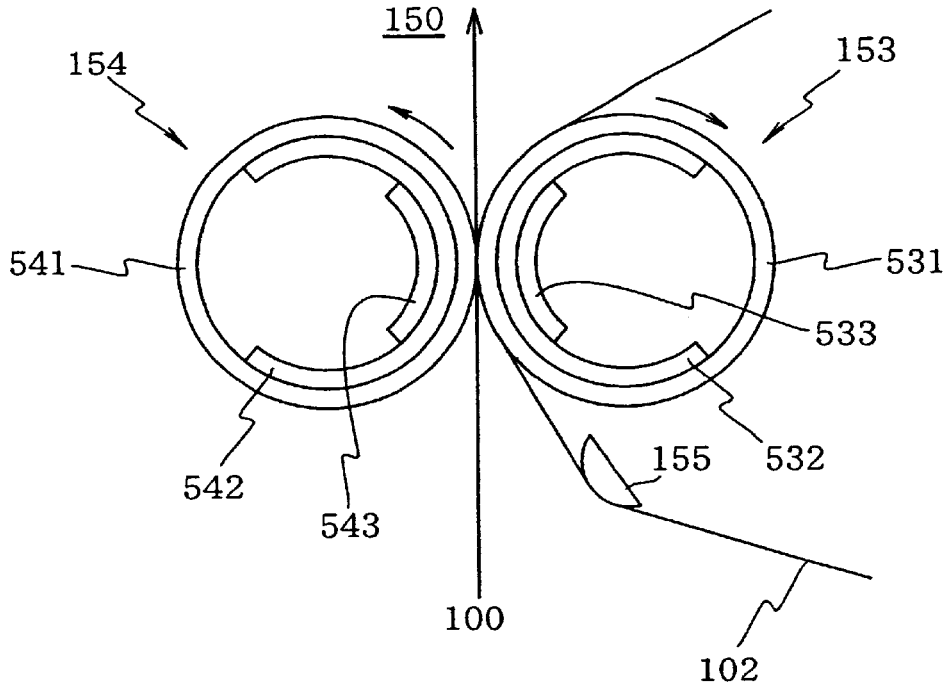
FIG. 5 schematically shows an example of a transfer-fixation block used in the image formation apparatus of the third embodiment of the present invention.

In the aforementioned third embodiment, the transfer-fixation block 150 includes a heating roller 151 and a transfer-fixation roller 152. However, it is also possible to employ a transfer-fixation block 150 as shown in FIG. 5.

This transfer-fixation block 150 includes a pair of heating rollers 153 and 154, each consisting of: a cylindrical rotary member having a thin thickness 531, 541; an arc-shaped support member 532, 542 arranged in contact with the inner surface of the rotary member 531, 541 and supporting the rotary member rotatably; and a line-shaped heat generator 533, 543 attached to the inner surface of the support member 532, 542 so as to oppose to each other.

Moreover, a semicircular member 155 supporting the travel of the belt-shaped image carrier 102 functions to widen the transfer-fixation nip in the transfer-fixation block 150. The recording medium 100 such as a paper passes through the pair of heating rollers 153 and 154, during which the full color image is transferred and fixed from the belt-shaped image carrier 102 onto the recording medium 100 by the heat and pressure from the heating rollers 153 and 154.

The heating rollers 153 and 154 substantially heat only the transfer and fixation region where the color image is transferred and fixed from the belt-shaped image carrier 102 onto the recording medium 100, which reduces power consumption.

Figure 6:
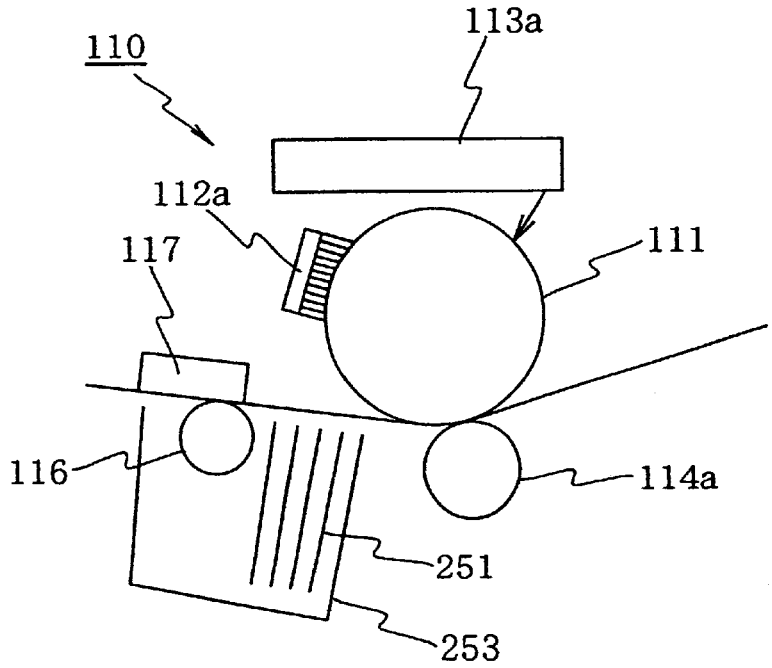
FIG. 6 schematically shows an example of a color image formation unit used in the image formation apparatus of the third embodiment of the present invention.

The color image formation units 110 to 140 shown in FIG. 4 may also have a configuration as shown in FIG. 6. The color image formation unit 110 employs a brush charging 112*a* for charging the photosensitive drum 111, and a laser operation optical system 113*a* as latent image formation unit for forming an electrostatic latent image on the photosensitive drum 111. Moreover, the electrostatic transfer unit may be a roller transfer 114*a*. Moreover, the heat generator 117 of the solvent removal unit may be a heat roller. Moreover, the photosensitive roller 111 may be charged by the discharge unit and corona charger in combination.

In the aforementioned image formation apparatus 101, the electrostatic type developing unit 253 employs a plurality of line heads 251. However, the line heads 251 may be such that a number of small nozzles are arranged in a line shape. Moreover, it is also possible to provide a migration electrode for supplying liquid developer in the vicinity of the line heads 251 for supplying liquid developer to the line heads 251. Furthermore, explanation has been given on a case that the photosensitive drum has minus a negative charge and the transfer bias applied to the electrostatic transfer unit has plus a positive charge. However, the present invention is not to be limited to this. The charge polarity of the toner in the liquid developer is also not to be limited to a particular one.

As has been described above, the image formation apparatus according to the present invention enables a user to obtain a stable monochromatic or color image of high resolution, accuracy and reliability. The image formation apparatus has a long service life and can be realized at a low cost.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 11-065620 (Filed on Mar. 11, 1999) and Japanese Patent Application No. 11-065621 (Filed on Mar. 11, 1999) including specification, claims, drawings and summary are incorporated herein by reference in its entirety.

What is claimed is:

1. An image formation apparatus comprising:

an electrostatic latent image formation body;

a latent image forming unit for forming an electrostatic latent image on the electrostatic latent image formation body;

a belt-shaped image carrier which is brought into contact with the electrostatic latent image formation body, so that the electrostatic latent image is transferred to the belt-shaped carrier;

a developing unit for supplying a liquid developer containing toner particles and carrier liquid to a surface of the belt-shaped image carrier not in contact with the electrostatic latent image formation body, so as to form a developed image;

a solvent removal unit for removing the carrier liquid from the developed image so as to form a toner-developed image, the solvent removal unit including a heat generator and a squeeze drying roller arranged in such a manner that the belt-shaped image carrier is pressed between the heat generator and the squeeze drying roller; and a transfer-fixation block for transferring and fixing the toner-developed image from the belt-shaped image carrier onto a recording medium.

2. The image formation apparatus as claimed in claim 1, wherein the developing unit is an electrostatic-type developing unit in which the liquid developer electrostatically transfers to an electrostatic latent image by way of an electric field without any contact with the belt-shaped image carrier.

3. The image formation apparatus as claimed in claim 1, said apparatus further comprising an electrostatic transfer unit for electrostatically transferring the electrostatic latent image from the electrostatic latent image formation body onto the belt-shaped image carrier.

4. The image formation apparatus as claimed in claim 1, wherein the squeeze drying roller is arranged inside the developing unit.

5. The image formation apparatus as claimed in claim 1, wherein the electrostatic latent image formation body has a shape of a rotary drum and is in contact with an inner surface of the belt-shaped image carrier.

6. The image formation apparatus as claimed in claim 1, wherein the transfer-fixation block includes a heatable guide block for guiding the travel of the belt-shaped image carrier and a fixation roller which is in a pressed contact relationship with the guide block.

7. The image formation apparatus as claimed in claim 6, wherein the heat generator of the solvent removal unit is built in the guide block.

8. An image formation apparatus comprising:

a belt-shaped carrier;

a plurality of electrostatic latent image formation bodies arranged along the traveling path of the belt-shaped image carrier, latent image formation units for forming respective electrostatic latent images on respective ones of the electrostatic image formation bodies;

the belt-shaped image carrier being brought into contact with each of the electrostatic latent image formation bodies and traveling along a predetermined path, so that the electrostatic latent images are transferred to the belt-shaped carrier;

a developing unit for supplying a liquid developer containing toner particles and carrier liquid, to a surface of the belt-shaped image carrier not in contact with the electrostatic latent images, so as to form developed images;

color image formation units each including a solvent removal unit for removing the carrier liquid from the developed image so as to form toner-developed images from the developed images; and a transfer-fixation block arranged on the traveling path of the belt-shaped image carrier for transferring and fixing the toner-developed images from the belt-shaped image carrier onto a recording medium.

9. The image formation apparatus as claimed in claim 8, wherein the developing unit is an electrostatic-type developing unit in which liquid developer is electrostatically transferred to the electrostatic latent images by way of an electric field without any contact with the belt-shaped image carrier.

10. The image formation apparatus as claimed in claim 8, wherein each of the color image formation units includes an electrostatic transfer unit for electrostatically transferring the electrostatic latent image from the respective electrostatic latent image forming body onto the belt-shaped image carrier.

11. The image formation apparatus as claimed in claim 8, wherein each solvent removal unit includes a heat generator and a squeeze drying roller arranged in such a manner that the belt-shaped image carrier is pressed between the heat generator and the squeeze drying roller.

12. The image formation apparatus as claimed in claim 11, wherein the squeeze drying roller is arranged inside the developing unit.

13. The image formation apparatus as claimed in claim 8, wherein the electrostatic latent image formation bodies are drum-shaped rotary electrostatic latent image formation bodies, each having an identical diameter and being in contact with an inner surface of the belt-shaped image carrier.

14. The image formation apparatus as claimed in claim 13, wherein mutual distances between contact points of the drum-shaped electrostatic latent image formation bodies with the belt-shaped image carrier are equal to an integral multiple of the circumference of one of the drum-shaped electrostatic latent image formation bodies.

15. The image formation apparatus as claimed in claim 13, wherein the length of the belt-shaped image carrier is equal to an integral multiple of the circumference of one of the drum-shaped electrostatic latent image formation bodies.

16. An image formation apparatus comprising:

an electrostatic latent image formation body;

a latent image forming unit for forming an electrostatic latent image on the electrostatic latent image formation body;

a belt-shaped image carrier which is brought into contact with the electrostatic latent image formation body, so that the electrostatic latent image is transferred to the belt-shaped carrier;

a developing unit for supplying a liquid developer containing toner particles and carrier liquid to a surface of the belt-shaped image carrier not in contact with the electrostatic latent image formation body so as to form a developed image;

a solvent removal unit for removing the carrier liquid from the developed image so as to form a toner-developed image, the solvent removal unit including a heat generator and a squeeze drying roller arranged in such a manner that the belt-shaped image carrier is pressed between the heat generator and the squeeze drying roller; and a transfer-fixation block for transferring and fixing the toner-developed image from the belt-shaped image carrier onto a recording medium, the transfer-fixation block including a heatable guide block for guiding the travel of the belt-shaped image carrier and a fixation roller which is in a pressed contact relationship with the guide block;

wherein a heat generator of the solvent removal unit is built in the guide block.

17. The image formation apparatus as claimed in claim 16, wherein the developing unit is an electrostatic-type developing unit in which the liquid developer electrostatically transfers to an electrostatic latent image due to an electric field without any contact with the belt-shaped image carrier.

18. The image formation apparatus as claimed in claim 16, further comprising an electrostatic transfer unit for electrostatically transferring the electrostatic latent image from the electrostatic latent image formation body onto the belt-shaped image carrier.

19. The image formation apparatus as claimed in claim 16, wherein the electrostatic latent image formation body has a shape of a rotary drum and is in contact with an inner surface of the belt-shaped image carrier.

* * * * *